US008490295B2

(12) United States Patent
Kramer

(10) Patent No.: US 8,490,295 B2
(45) Date of Patent: Jul. 23, 2013

(54) INSOLE WITH FLEXIBLE, SHOCK ABSORBING UNIT

(76) Inventor: Hyman Kramer, Bronx, NY (US)

( * ) Notice: Subject to any disclaimer, the term of this patent is extended or adjusted under 35 U.S.C. 154(b) by 704 days.

(21) Appl. No.: 12/648,541

(22) Filed: Dec. 29, 2009

(65) Prior Publication Data

US 2010/0170111 A1 Jul. 8, 2010

(30) Foreign Application Priority Data

Jan. 2, 2009 (CN) ..... 2009 1 0003425

(51) Int. Cl.
*A43B 7/06* (2006.01)
*A43B 13/18* (2006.01)

(52) U.S. Cl.
USPC ..... 36/3 B; 36/28; 36/44

(58) Field of Classification Search
USPC ..... 36/3 B, 28, 44, 29, 141, 30 R
See application file for complete search history.

(56) References Cited

U.S. PATENT DOCUMENTS

| | | | | |
|---|---|---|---|---|
| 2,347,207 | A * | 4/1944 | Margolin | 36/3 B |
| 4,642,912 | A * | 2/1987 | Wildman et al. | 36/44 |
| 4,887,367 | A * | 12/1989 | Mackness et al. | 36/28 |
| 5,367,791 | A * | 11/1994 | Gross et al. | 36/31 |
| 5,860,229 | A * | 1/1999 | Morgenstern | 36/141 |
| 6,199,304 | B1 * | 3/2001 | Ludemann | 36/44 |
| 6,874,251 | B2 * | 4/2005 | Moretti | 36/3 B |
| 7,246,454 | B2 | 7/2007 | Kramer | |
| 7,249,425 | B2 * | 7/2007 | Wang | 36/29 |
| 2003/0061733 | A1 * | 4/2003 | Karsten | 36/43 |
| 2004/0221484 | A1 * | 11/2004 | Wang | 36/29 |

FOREIGN PATENT DOCUMENTS

CN 200810128341.1 7/2008

* cited by examiner

*Primary Examiner* — Ted Kavanaugh

(74) *Attorney, Agent, or Firm* — Carlson, Gaskey & Olds, P.C.

(57) ABSTRACT

An insole includes an upper foot contacting substrate and a lower substrate, wherein openings are provided in both the upper foot contacting substrate and the lower substrate. These openings are at least partially kept in alignment with each other to receive a flexible, shock absorbing unit therein. The insole according to the invention provides a good absorbance and at the same time improves the air flow inside the insole. Therefore, the moisture around the wearer's foot can easily escape, thus keeping foot dry.

20 Claims, 2 Drawing Sheets

INSOLE WITH FLEXIBLE, SHOCK ABSORBING UNIT

REFERENCE TO RELATED APPLICATION

This application claims priority to Chinese Patent Application No. 200910003425.7 filed Jan. 2, 2009.

BACKGROUND

The present invention relates to the improvement of articles of footwear specifically the insoles of footwear.

Insoles with flexible, shock absorption material are known in the art, such as is found in U.S. Pat. No. 7,246,454. The insole comprises an upper foot contacting substrate, a lower substrate, and a flexible, shock absorbing substrate having a plurality of cushioning cylinders. Carry strips are trapped between the upper and lower substrates.

CN200810128341.1, which was filed with the title "Insole" by the same applicant as the present invention, discloses improvements on insoles known in the art and described above. The insole disclosed by CN200810128341.1 includes at least one of the upper surface and the bottom surface of the flexible, shock absorbing substrate having a plurality of cushioning cylinders extending therefrom. In addition, the plurality of cushioning cylinders are connected with each other through connecting webs.

However, because the flexible, shock absorbing substrate, which is formed as a single body, is interposed between the upper substrate and the lower substrate, such insole may not ensure good ventilation due to the flexible, shock absorbing substrate. As a result, the moisture or warm air around wearer's foot will be prevented from easily escaping, which may lead to unfavorable results and conditions.

SUMMARY

An exemplary insole offers good shock absorbance, and also improves the ventilation in the insole. This allows moisture around the wearer's foot to easily escape, keeping the foot dry.

In embodiments, the insole comprises an upper foot contacting substrate and a lower substrate. Openings are provided in both the upper foot contacting substrate and the lower substrate. These openings are kept at least partially in alignment with each other to receive a flexible, shock absorbing unit therein.

In one embodiment, at least one of the upper surface and the bottom surface of the flexible, shock absorbing unit has a plurality of cushioning cylinders extending therefrom. The plurality of cushioning cylinders are connected to each other through connecting webs.

In another embodiment, the flexible, shock absorbing unit is generally bonded within the openings. As a non-limiting example, the bond can be achieved by means of adhesive. However, adhesive may not completely fill the entire openings, creating gaps between the flexible, shock absorbing unit and both the upper foot contacting substrate and the lower substrate. This results in an air path formed within the insole, allowing air to freely flow from the upper foot contacting substrate to the lower substrate.

In another embodiment, the flexible, shock absorbing unit is also able to cushion external impacts. In yet another embodiment, openings are provided in both the upper substrate and the lower substrate. The flexible, shock absorbing unit is then mounted inside these openings. Therefore, the air flow inside the insole is effectively improved and the moisture around the wearer's foot can escape easily, keeping the wearer's foot dry.

PREFERRED EMBODIMENTS

The following examples will be discussed with reference to the accompanying drawings.

Figure 1:
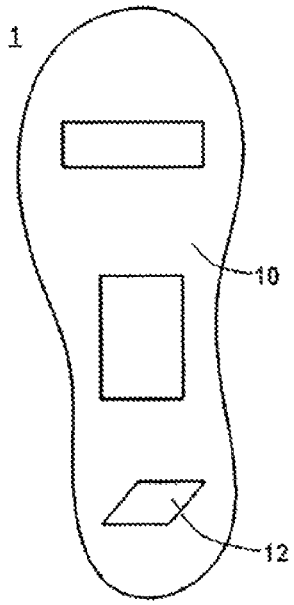
FIG. 1 shows a top view of the insole of the present invention, including openings of different configurations

As shown in FIG. 1, an insole 1 includes rises an upper foot contacting substrate 10 and a lower substrate 20 (not shown in FIG. 1), which has a shape corresponding to the wearer's foot. The upper foot contacting substrate 10 and the lower substrate 20 are generally bonded together by means of adhesive. Openings 12, 22 (shown in FIGS. 3 and 4) are provided in the upper foot contacting substrate 10 and the lower substrate 20 respectively. The openings 12, 22 are kept at least partially in alignment with each other when the upper foot contacting substrate 10 and the lower substrate 20 are bonded together. It is conceivable to one skilled in the art that the openings 12, 22 can be designed in a variety of configurations, for example as a rectangle, circle, and parallelogram. If needed, one or more openings 12, 22 of the same configuration or of different configurations can be provided in the upper foot contacting substrate 10 or the lower substrate 20.

Figure 2:
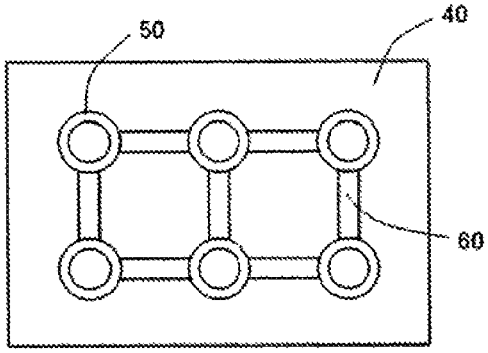
FIG. 2 shows a bottom view of the flexible, shock absorbing unit according of the present invention.

The insole further includes a shock absorbing flexible unit 40, as shown in FIG. 2. On one surface of the flexible, shock absorbing unit 40 are a plurality of cushioning cylinders 50 extending therefrom. The cushioning cylinders 50 are hollow cylinders and can be made from plastic, rubber or other cushioning materials. As shown in FIG. 2, the cushioning cylinders 50 can be connected with each other through connecting webs 60 in the horizontal and vertical directions. Alternatively, the connecting webs 60 can also connect the cushioning cylinders 50 in the diagonal direction. Moreover, the configuration of cushioning cylinders 50 is not limited to the cylinders shown in the Figures, and can be designed as one of ordinary skill in the art would understand. Such examples may include a prism or cone.

For further details of the structure of the insole 1 and the shock absorbing flexible unit 40, one may refer to U.S. Pat. No. 7,246,454 and CN200810128341.1 respectively.

The connecting webs 60 integrate all of the cushioning cylinders 50 into a single unit. Therefore, when there are external impacts acting on the flexible, shock absorbing units 40, the cushioning cylinders 50 will react as a single body. This is due to the existence of the connecting webs 60, which allow the cushioning cylinders 50 to effectively absorb an impact.

Figure 3:
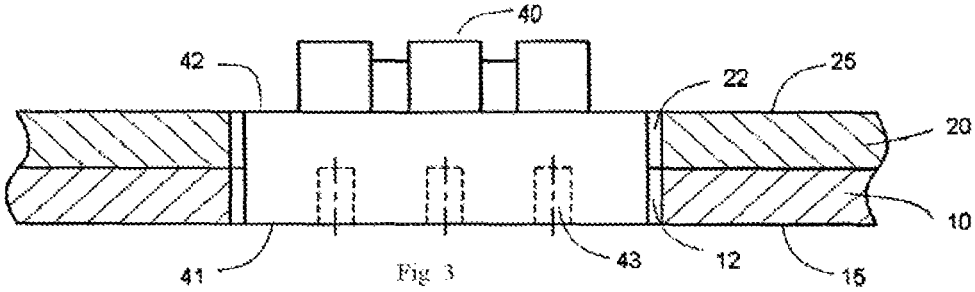
FIG. 3 shows a schematic side view of the present invention with even gaps.

FIG. 3 shows a schematic view where the flexible, shock absorbing unit 40 is mounted within the openings 12, 22 of the upper foot contacting substrate 10 and the lower substrate 20 respectively. The outer profile of the flexible, shock absorbing unit 40 should be designed to fit the shape of the openings 12, 22. In consideration of the comfort of the wearer, the surface 41 of the flexible, shock absorbing unit 40 without cushioning cylinders 50 is located such that it is substantially flush with the foot contacting surface 15 of the upper foot contacting substrate 10. This avoids the undesirable feeling of protrusions rubbing on the wearer's sole. Alternatively, in some embodiments, the surface 41 can be a either higher or lower than the foot contacting surface 15.

Moreover, on the surface 41 of the flexible, shock absorbing unit 40 there are additional holes 43 which can partially enhance the air flow within the insole. As shown in FIG. 3, these holes 43 can be designed as blind holes. Alternatively, in a preferred embodiment not shown, the holes 43 can be formed as through holes extending from surface 41 to the top face of cushioning cylinders 50. The through holes can further improve the air flow within the insole.

Figure 4:
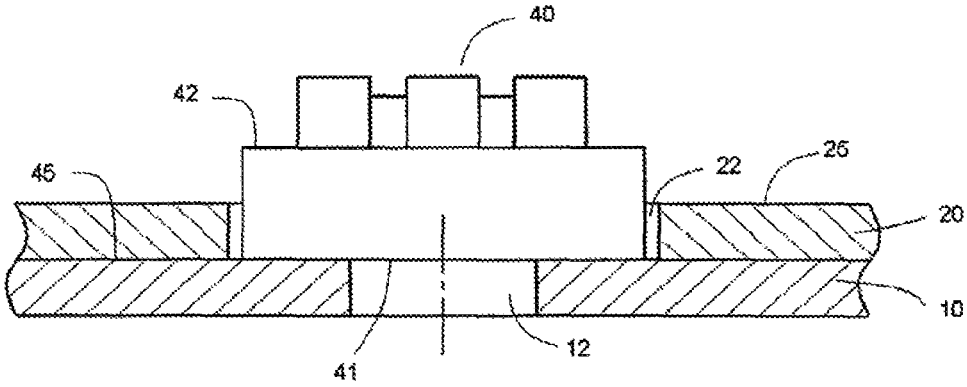
FIG. 4 shows a perspective side view of the present invention with passageways connecting air flow gaps.

In an alternative embodiment as shown in FIG. 4, the surface 41 can be located such that it is flush with the interface between the upper foot contacting substrate 10 and the lower substrate 20. Thus, the opening 12 of the upper foot contacting substrate 10 can be smaller than the opening 22 of the lower substrate 20, such that only a portion of surface 41 is exposed.

As shown in FIG. 3, the surface 42 of the flexible, shock absorbing unit 40 with cylinders 50 is arranged substantially flush with the bottom surface 25 of the lower substrate 20, such that the cushioning cylinders 50 project over the bottom surface 25 of the lower substrate 20. In one embodiment, the length of cushioning cylinders 50 can be selected to adjust the height of the cushioning cylinders 50 projecting over the bottom surface 25, thus achieving the optimal cushioning effect. In another embodiment, the difference in height between the surface 41 and the bottom surface 25 can be chosen to adjust the height of the cushioning cylinders 50 projecting over the bottom surface 25.

The flexible, shock absorbing unit 40 is generally secured to the upper foot contacting substrate 10 and the lower substrate 20 through bonding by means of adhesive. In one embodiment, bonding should be carried out such that the openings 12, 22 are not entirely filled. For example, adhesive may be applied such that it extends through the entire depth of the openings 12, 22 but only over a part of the periphery thereof. Alternatively, in the embodiment shown in FIG. 4, passageways are formed on the surface 41 of the flexible, shock absorbing unit 40 such that the passageways allow communication between the opening 12 and the opening 22. Thus, gaps still exist between the flexible, shock absorbing unit 40 and both the upper foot contacting substrate 10 and the lower substrate 20. The gaps can further improve the air flow inside the insole so that the moisture can easily escape, keeping the foot dry.

It should be appreciated that the above exemplary embodiment is one example for carrying out the invention, and is by no means intended to limit the scope, applicability, or configuration of the invention in any way. Although a preferred embodiment has been disclosed, a worker of ordinary skill in this art would recognize that certain modifications would come within the scope of this invention. For that reason, the following claims should be studied to determine the true scope and content of this invention.

What is claimed is:

1. An insole comprising:

an upper foot contacting substrate;

a lower substrate; and a plurality of openings, the openings provided in both the upper foot contacting substrate and the lower substrate, the openings at least partially aligned with each other; and a flexible, shock absorbing unit within the plurality of openings, wherein one of an upper surface and a bottom surface of the flexible, shock absorbing unit includes a plurality of cushioning cylinders extending therefrom, the plurality of cushioning cylinders connected through a plurality of connecting webs, wherein a plurality of air flow holes are disposed in another of the upper surface and bottom surface not having a plurality of cushioning cylinders.

2. The insole according to claim 1, wherein the flexible, shock absorbing unit is arranged such that the upper surface of the flexible, shock absorbing unit is flush with a contacting surface of the upper foot contacting substrate.

3. The insole according to claim 1, wherein the flexible, shock absorbing unit is arranged such that the surface of the flexible, shock absorbing unit is positioned higher than the contacting surface of the upper foot contacting substrate.

4. The insole according to claim 1, wherein the flexible, shock absorbing unit is arranged such that the surface of the flexible, shock absorbing unit is positioned lower than the contacting surface of the upper foot contacting substrate.

5. The insole according to claim 1, wherein the flexible, shock absorbing unit is arranged such that the surface of the flexible, shock absorbing unit without cushioning cylinders is flush with an interface between the upper foot contacting substrate and the lower substrate.

6. The insole according to claim 1, wherein the air flow holes are formed as through holes extending from the surface of the flexible, shock absorbing unit without cushioning cylinders to the top face of cushioning cylinders.

7. The insole according to claim 1, wherein the flexible, shock absorbing unit is received within the openings such that gaps are formed between the flexible, shock absorbing unit and both the upper foot contacting substrate and the lower substrate to form an air path.

8. The insole according to claim 1, wherein the flexible, shock absorbing unit is bonded to the openings.

9. The insole according to claim 8, wherein the flexible, shock absorbing unit is bonded to the openings with adhesive such that the adhesive does not fill the opening entirely and has an air path.

10. The insole according to claim 1, wherein the openings are shaped as polygons.

11. The insole according to claim 1, wherein the openings are shaped as circles.

12. The insole according to claim 1, wherein the openings are shaped as rectangles.

13. The insole according to claim 1, wherein the plurality of connecting webs extend between the plurality of cylinders in at least a horizontal direction.

14. The insole according to claim 1, wherein the plurality of connecting webs extend between the plurality of cylinders in at least a vertical direction.

15. The insole according to claim 1, wherein the plurality of connecting webs extend between the plurality of cylinders in at least a diagonal direction.

16. The insole according to claim 1, wherein the plurality of cushioning cylinders are arranged to react as a single body in response to an external impact on the flexible, shock absorbing unit.

17. The insole according to claim 1, wherein the plurality of cushioning cylinders are hollow.

18. The insole according to claim 9, wherein the adhesive extends through an entire depth of each of the plurality of openings and only over a part of the periphery of each of the plurality of openings.

19. An insole comprising:

an upper foot contacting substrate;

a lower substrate; and a plurality of openings, the openings provided in both the upper foot contacting substrate and the lower substrate, the openings at least partially aligned with each other; and a flexible, shock absorbing unit within the plurality of openings, wherein one of an upper surface and a bottom surface of the flexible, shock absorbing unit includes a plurality of cushioning cylinders extending therefrom, the plurality of cushioning cylinders connected through a plurality of connecting webs, wherein the flexible, shock absorbing unit is received within the openings such that gaps are formed between the flexible, shock absorbing unit and both the upper foot contacting substrate and the lower substrate to form an air path.

20. The insole according to claim 19, wherein the plurality of connecting webs extend between the plurality of cylinders in at least a horizontal direction.

* * * * *